US005837109A

United States Patent [19]

Fujii et al.

[11] Patent Number: 5,837,109

[45] Date of Patent: Nov. 17, 1998

[54] APPARATUS FOR TREATING A STRIP

[75] Inventors: Tadashi Fujii; Eiichiro Sugioka, both of Yamaguchi, Japan

[73] Assignee: Toyo Kohan Co., Ltd., Japan

[21] Appl. No.: 737,489

[22] PCT Filed: May 22, 1995

[86] PCT No.: PCT/JP95/00982

§ 371 Date: Jan. 31, 1997

§ 102(e) Date: Jan. 31, 1997

[87] PCT Pub. No.: WO95/32322

PCT Pub. Date: Nov. 30, 1995

[30] Foreign Application Priority Data

| | | | |
|---|---|---|---|
| Jun. 14, 1994 | [JP] | Japan | 6-156603 |
| Feb. 17, 1995 | [JP] | Japan | 7-053325 |
| Feb. 17, 1995 | [JP] | Japan | 6-134970 |

[51] Int. Cl.[6] ..... C25D 17/00

[52] U.S. Cl. ..... 204/206; 204/222; 204/225; 204/269; 204/286

[58] Field of Search ..... 204/206, 222, 204/225, 275, 269

[56] References Cited

U.S. PATENT DOCUMENTS 2,588,910 3/1952 Davis ..... 204/222 X 2,650,904 9/1953 Davis et al. ..... 204/222

*Primary Examiner*—Donald R. Valentine

*Attorney, Agent, or Firm*—Morrison Law Firm

[57] ABSTRACT

The present invention relates to an apparatus for treating a strip such as a steel strip. The first object is to provide an electrode opening and closing mechanism having a simple construction. The second object is to uniform the flow of a solution around the electrode. The third object is to prevent causing irregularities in the treatment, caused by the variation of surface level of the solution between the electrodes. To attain the first object, one of the mutually facing electrodes is stationarily secured, and there is provided an opening and closing mechanism for moving the other electrode. To attain the second object, stabilizing members for solution flow are provided on the electrodes, a fluid-storing room is formed between the stabilizing member for solution flow and the electrode, and a slit-shaped hole for uniformly flowing the solution between the electrodes from the fluid-storing room, is formed at right angles to the travelling direction of the strip. To attain the third object, a bus bar has at its portion for suspending the electrode a bent-shaped portion so that the electrode is always immersed into the treating solution.

28 Claims, 7 Drawing Sheets

FIG. 1(a)
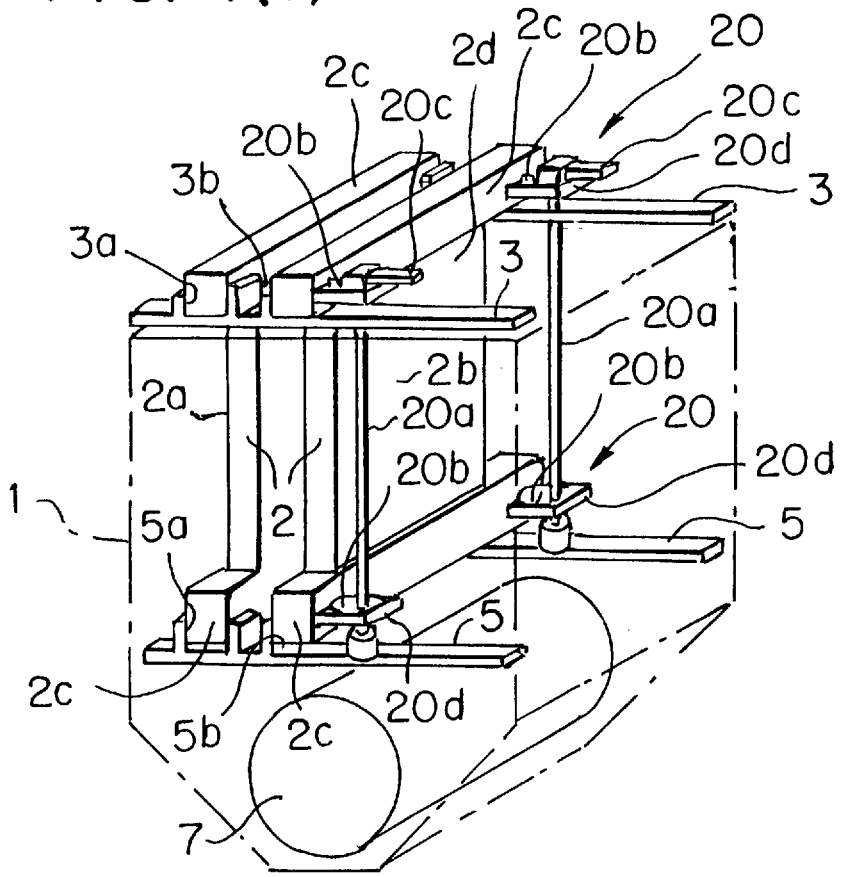
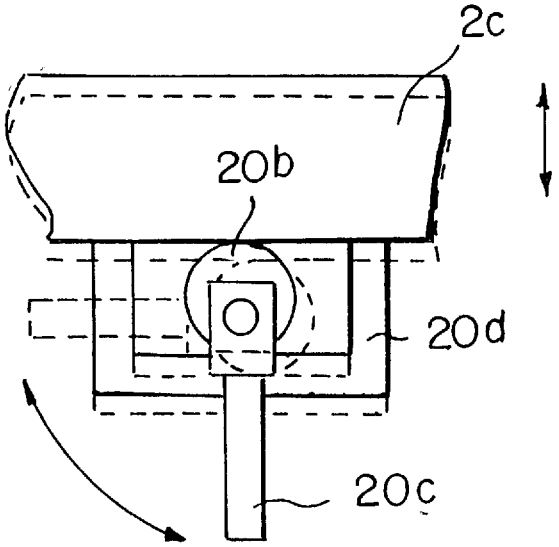
FIG. 1(b)

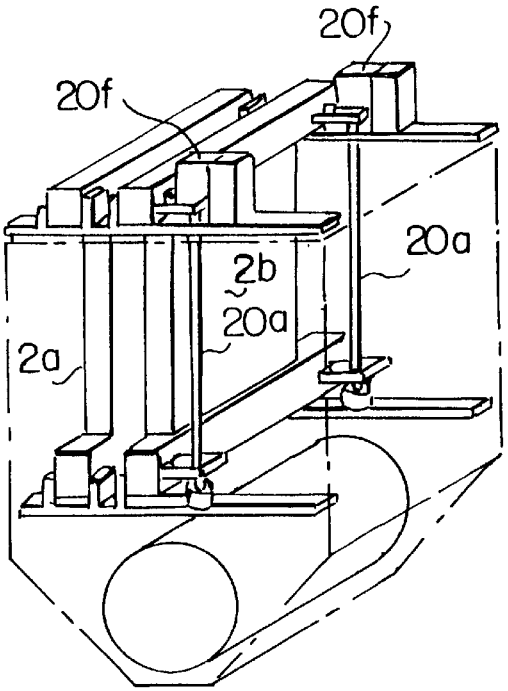
FIG. 2
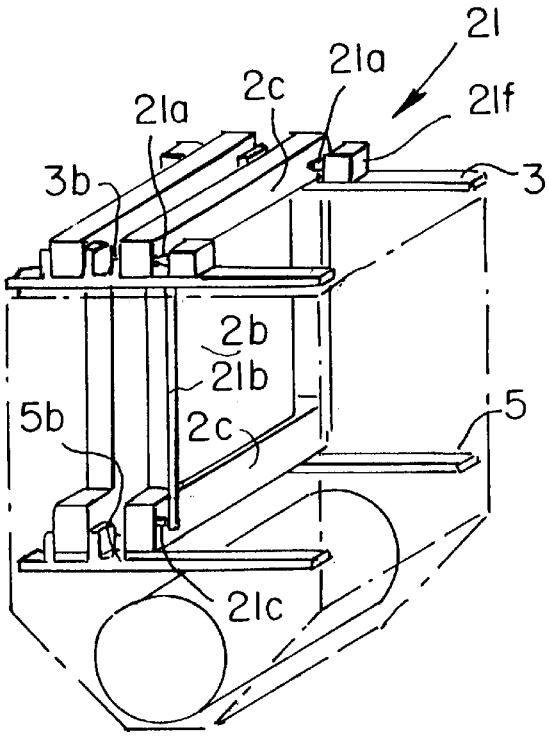
FIG. 3
FIG. 4
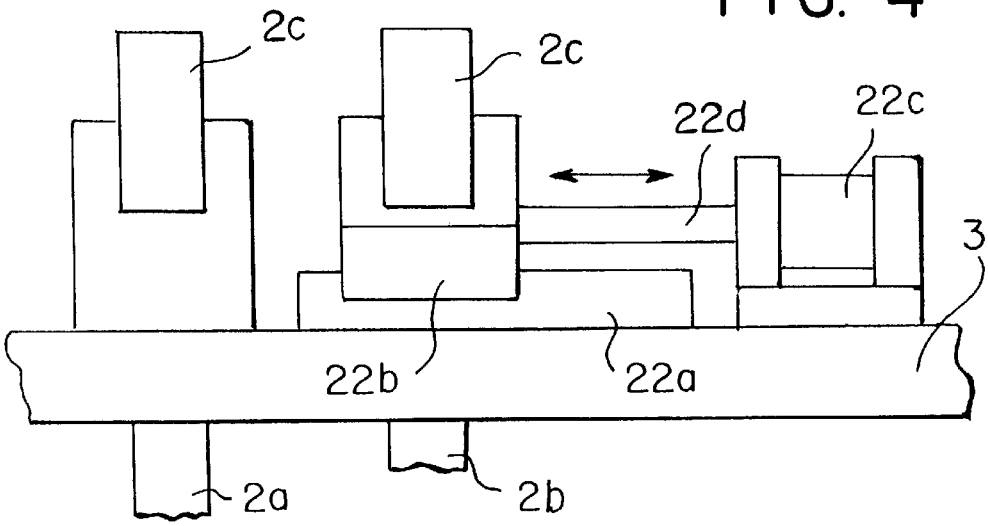

APPARATUS FOR TREATING A STRIP

BACKGROUND OF THE INVENTION

The present invention relates to an apparatus for treating a strip such as a steel strip, for example, a plating apparatus, a cleaning apparatus and the like, and especially to a strip treating apparatus in which homopolar electrodes as anodes or cathodes are arranged so as to face to each other in a bath tank, and a strip is travelled between these electrodes.

For the purpose of increasing production and improving productivity in the above-described strip treating apparatus, it has been required to decrease the distance between a strip and each of electrodes such as anodes or cathodes, to stir a treating solution such as a plating solution between the strip and each of the electrodes such as anodes or cathodes, and to supply ions between the strip and each of the electrodes such as anodes or cathodes. In view of these circumstances, the applicant has developed an apparatus in which insulators (stabilizers) are provided so as to be projected face to face or in zigzags on opposite inner surfaces of homopolar electrodes arranged so as to face to each other, and each of these insulators is provided with a slant face inclined from a side of the electrode toward the strip in a travelling direction of the strip (Japanese Patent Provisional Publication No. H3-20494). It became thus possible to extremely decrease the distance between the homopolar electrodes so as to remarkably improve productivity with the use of the strip treating apparatus.

However, the above-described strip treating apparatus has involved problems, and has been required to be further improved.

There is the first problem which relates to a mechanism for adjusting the distance between the electrodes. In the above-described strip treating apparatus, the distance between the electrodes is extremely short. Use of the electrodes stationarily arranged thus makes it impossible to pass a rope between the electrodes, which is to be used for passing the strip through the strip treating apparatus prior to the start thereof. The connecting portion of the strips by means of a welding and so on has a relatively large thickness. It has therefore been considered at the time of development of the apparatus that the above-mentioned connecting portion would be in contact with the stabilizer to cause the breakage thereof. For these reasons, there has been required a mechanism for opening and closing the electrodes.

There have conventionally been provided an opening and closing mechanism and operating members thereof, in which both of the electrodes were openable against each other as shown in FIG. 13, in order to secure a space necessary for an operation of passing a rope between the electrodes, which is to be used for passing the strip through the strip treating apparatus prior to the start thereof, and to prevent the welded portion of the strips from being in contact with the stabilizer during travelling of the strip.

A treating solution such as a plating solution (not shown) is filled in a vertical-pass type bath tank 1 as shown in FIG. 13. As electrodes 2, there may be used one of anodes and cathodes, or electrodes which are changeable into anodes or cathodes. The upper portions of the respective electrodes 2 are supported by means of upper electrode-holders 3. On these upper electrode-holders 3, there are provided pneumatic cylinders 4 for opening and closing the upper portions of the electrodes. The lower portions of the respective electrodes 2 are supported by means of lower electrode-holders 5. On these lower electrode-holders 5, there are provided cams 6 for opening and closing the lower portions of the electrodes. The opening or closing of the electrodes is carried out by operating all of the pair of pneumatic cylinders 4 and the pair of cams 6 for each electrode.

Both of the electrodes are movable in this manner. There has been a necessity of securing in the bath tank 1 a space necessary for moving also the electrode arranged farthest from a conducting drum 7, i.e., the electrode 2*a* arranged at the side of the wall of the bath tank 1, and a large-sized bath tank has therefore been required, leading to an increased cost. When the strip treating apparatus was attempted to be mounted on the conventional bath tank 1 in which there could not be prepared the above-mentioned space, there has been a problem of necessity of modifying the bath tank 1.

In addition, the operating members for the cams 6 for opening and closing the lower portions of the electrodes 2 have necessarily been arranged so as to project outside from the side wall of the bath tank 1, and more specifically, holes for these operating members have necessarily been formed in the bath tank 1, thus leading to a problem of leakage of the bath.

After a practical operation, it has been recognized that a welded portion formed by lap-welding the strips each having a thickness of 1.2 mm could pass through between the stabilizers arranged apart from each other by a distance of 6 mm, without being in contact with the stabilizers. It has also been recognized that the opening and closing of the electrodes 2 was required only when carrying out the operation of passing the rope between the electrodes, which is to be used for passing the strip through the strip treating apparatus prior to the start thereof. The above-mentioned facts have been to confirm the solvability of the problems described above, as well as the possibility of installing the strip treating apparatus in a smaller space.

There is the second problem which relates to the stirring of a treating solution such as a plating solution. According to the above-described strip treating apparatus, a plurality of penetration holes 9 are formed in the electrode 2 between the stabilizers 8 so as to interconnect the inner and outer surfaces of the electrode 2 as shown in FIG.14 (refer to Japanese Patent Publication No. H6-13759). Since the strip treating apparatus has such a construction, the travelling of the strip 10 between the electrodes 2,2 (the opposing electrode 2 not shown) causes to produce the turbulence of the solution as shown in the form of arrows between the stabilizers 8, 8, resulting in circulation of the solution between the inner surface side and the outer surface side of the electrode 2 through the penetration holes 9. As a result, the exhausted solution on the inner side of the electrode is substituted by the fresh solution on the outer side of the electrode.

According to this stirring method, a flow velocity of the solution between the penetration holes is however decreased, resulting in occurrence of a striped flow having an uniform velocity. Such a striped flow with ununiform velocity causes a chemical ununiformity of the bath. It may be possible to prevent the occurrence of the striped flow by forming a vertical long slit in the electrode along the travelling direction of the strip, connecting both penetration holes. This method causes a problem of decreased strength of the electrode. In order to solve this problem, a dimension of the electrode is required to be increased.

There is the third problem which relates to the stability of a level of a treating solution during the travelling of the strip between the electrodes. When the strip treating apparatus is operated under the condition that an extreme short distance between the electrodes 2, 2 such as anodes or cathodes is maintained as shown in FIG. 15 (FIG. 15(*a*) is a plane view illustrating the apparatus, with one electrode removed, in which a part of the strip is cut off so as to facilitate the understanding of the apparatus), the meniscus level between the electrodes unstably varies due to the downward flow of the bath caused by the travelling of the strip in the downward direction, and more specifically, the meniscus level moves up and down as shown in reference marks "p" and "q", leading to a plating irregularity or a cleaning irregularity.

In view of these circumstances, a solution supplying apparatus 11 is provided above the electrodes 2 and a solution is supplied between the electrodes therethrough, so as to prevent the unstable moving of the meniscus level between the electrodes, as shown in FIG. 16 (FIG. 16(*a*) is a plane view illustrating the apparatus, with one electrode removed, in which a part of the strip is cut off so as to facilitate the understanding of the apparatus). In case of applying an electric current through a grid as in a cleaning apparatus, voltage drop is small even when the meniscus level is low. When the meniscus level becomes low and a distance between a conductor roll and the meniscus level becomes long in the plating apparatus, on the other hand, voltage drop becomes large, requiring an excessive electric power. Accordingly, an increased amount of solution is supplied between the electrodes 2, 2 in order to cause the meniscus level to move up to a high level.

There is thus required the solution supplying apparatus 11. Arrangement of such a solution supplying apparatus 11 above the anodes or cathodes accompanying with many kinds of complicated devices and pipes has however complicated a plating apparatus or a cleaning apparatus. In addition, it has not been easy to supply the solution between the electrodes 2, 2 which are able to be arranged so adjacently to each other by providing the stabilizers 8 on the electrodes (refer to FIG. 16). In order to achieve the above-mentioned supply of the solution, many kinds of other devices have further been required to be added. As a result, the cost of the plating apparatus or the cleaning apparatus has been increased and maintenance works have also been complicated. These matters have been important factors of prohibiting a spread of the plating apparatus or the cleaning apparatus in which the electrodes 2, 2 were able to be arranged so adjacently to each other by providing the stabilizers 8 on the electrodes (Japanese Patent Provisional Publication No. H3-20494).

OBJECTS AND SUMMARY OF THE INVENTION

In view of the foregoing, the first object of the present invention is to provide a strip treating apparatus such as a plating apparatus or a cleaning apparatus, which has an opening and closing mechanism for electrodes, which is able to be secured to a small-sized bath tank designed as a facility having the irreducible minimum scale of a demand, or the conventional bath tank, and in which mechanism a leakage of a bath is prevented.

The second object of the present invention is-to provide the plating apparatus and the cleaning apparatus having the above-mentioned construction, in which prescribed stabilizing members for solution flow are provided on the electrodes to cause the solution from the outer surface side of the electrode to flow uniformly toward the inner surface side of the electrode in a direction at right angles to the travelling direction of the strip, so as to prevent the occurrence of the above-mentioned striped flow.

The third object of the present invention is to provide a plate treating apparatus such as the plating apparatus or the cleaning apparatus, in which a plating irregularity or a cleaning irregularity caused by the unstable meniscus level between the electrodes can be prevented by a simple construction without providing the solution supplying apparatus 11.

In order to attain the above-mentioned first object of the present invention, an apparatus of the present invention for treating a strip, wherein homopolar electrodes are arranged so as to face to each other in a bath tank, and said strip is travelled between said electrodes to subject said strip to any one of a plating treatment, a cleaning treatment and another treatment, is characterized in that:

insulators are provided so as to be projected on opposite surfaces of said electrodes, and each of said insulators has a slant face inclined from a side of each of said electrodes toward said strip in a travelling direction of said strip;

one electrode of said homopolar electrodes arranged so as to face to each other is stationarily secured to said bath tank; and an opening and closing mechanism for adjusting a distance between said electrodes is provided at an other electrode of said homopolar electrodes arranged so as to face to each other.

When the homopolar electrodes are arranged vertically so as to face to each other in the bath tank, all of operating members of the above-mentioned opening and closing mechanism are preferably positioned above the surface of a bath in the bath tank.

The above-mentioned opening and closing mechanism may comprise a pair of electrode holders positioned on both end portions of the other electrode, frame-shaped followers provided at said pair of electrode holders, cam shafts rotatably supported on the electrode holders, cams secured to both end portions of the cam shafts, and fitted into the frame-shaped followers, and operating members provided at one end portions of the cam shafts.

When the homopolar electrodes are arranged vertically so as to face to each other in the bath tank, the above-mentioned opening and closing mechanism may comprise a bus bar connected to an upper end of the other electrode, upper electrode-holders positioned on an upper end portion of the other electrode, a sliding system for slidably supporting the bus bar on the upper electrode-holders, and a linear-type actuator for sliding the bus bar on the sliding system.

In order to attain the above-mentioned second object of the present invention, an apparatus of the present invention for treating a strip, wherein homopolar electrodes are arranged so as to face to each other in a bath tank, and said strip is travelled between said electrodes to subject said strip to any one of a plating treatment, a cleaning treatment and another treatment, is characterized in that:

stabilizers are provided on opposite surfaces of said electrodes, said stabilizers each having a slant face inclined from a side of each of said electrodes toward said strip in a travelling direction of said strip;

a plurality of penetration holes are formed in each of said electrodes on an upstream side and a downstream side of each of said stabilizers in a travelling direction of said strip to interconnect inner and outer surfaces of each of said electrodes with each other;

stabilizing members for solution flow are provided so as to face said penetration holes on both of said upstream side and said downstream side of each of said stabilizers, or only on said downstream side thereof;

a fluid-storing room is formed at a side of said penetration holes of each of said stabilizing members for solution flow; and a slit-shaped hole extending in a direction intersecting the travelling direction of said strip is formed in each of said stabilizing members for solution flow.

In the above-mentioned construction, it is preferable that the stabilizers have a function of the stabilizing members for solution flow, that the electrodes have denting portions, and the stabilizing members for solution flow are secured in the portions, and that the stabilizing members for solution flow is made of a material having heat-resistance property and/or chemical-resistance property.

It is preferable that mounting holes for connecting each of the above-mentioned electrodes and the above-mentioned stabilizing members for solution flow are formed in one of the each of the electrodes and the stabilizing members for solution flow, and bolts are secured on an other of the each of the electrodes and the stabilizing members for solution flow, the bolts being loosely fitted into the mounting holes, thereby absorbing a difference in expansion between the stabilizing members for solution flow and the electrodes due to thermal expansion thereof.

In the above-mentioned construction, the electrodes may be one of anodes or cathodes, or electrodes changeable into anodes or cathodes.

In order to attain the above-mentioned third object of the present invention, an apparatus of the present invention for treating a strip, wherein homopolar electrodes are arranged so as to face to each other in a bath tank, and said strip is travelled between said electrodes to subject said strip to any one of a plating treatment, a cleaning treatment and another treatment, is characterized in that:

an upper end of a electric discharging face of each of said electrodes is located below a surface of a bath in said bath tank.

In the above-mentioned construction, each of the electrodes may be supported at the upper end thereof by means of a bus bar covered with an insulating material, a portion of the bus bar for supporting each of the electrodes may be formed into a bent-shape, and the upper end of the electric discharging face of each of the electrodes may be located below the surface of the bath in the bath tank.

A function of the strip treating apparatus of the present invention for attainment of the first object of the present invention will be described hereafter. One electrode of homopolar electrodes which are to be arranged so as to face to each other is arranged at a prescribed position, and stationarily secured thereto. The other electrode is movably arranged at a prescribed position, and an opening and closing mechanism for the other electrode is provided. When passing through a rope between the electrodes, which is to be used for passing a strip through the strip treating apparatus prior to the start thereof, the other electrode is only opened to obtain a prescribed distance necessary for passing through the rope between the electrodes. In this stage, the above-mentioned one electrode is stationarily secured at the prescribed closed position. Since insulators (stabilizers) are also provided on this electrode, the strip may slide on the insulators without being in contact with this electrode during the passing of the rope between the electrodes, which is to be used for passing the strip through the strip treating apparatus prior to the start thereof, thus preventing the contact of the strip with the electrode. In this stage, the insulators (the stabilizers) are not damaged or broken, since the strip is not tensed. The construction in which the electrode on the side of the wall of the tank is designed as the stationary electrode, permits the use of a small-sized bath tank, since there is no need of preparing a space for moving the above-mentioned electrode, and also permits the application of the strip treating apparatus to a conventional bath tank which does not have such a space. Since the opening and closing mechanism provided only for the other electrode suffices,the cost of the opening and closing mechanism can be reduced by half.

In case that the homopolar electrodes are arranged vertically so as to face to each other in the bath tank, it is possible to release the necessity of forming holes for operating members of the opening and closing mechanism in the wall of the bath tank and of arranging the above-mentioned operating members so as to project outside from these holes, by arranging all of the operating members of the opening and closing mechanism above the surface of the bath in the bath tank, resulting in prevention of leakage of the bath, and prevention of the damage of the operating members caused by the immersion of the operating members in the bath. The operating members mean portions which generate the force for operating the opening and closing mechanism, they mean portions to be operated by hands of an operator, if manually operated, and they mean portions which generate the operating force, i.e., operating portions of rotary-type actuators such as rotary-type cylinders, linear-type actuators such as pneumatic actuators, and the like, if automatically operated.

The opening and closing mechanism comprises camshafts rotatably supported on a pair of electrode holders, having cams secured thereto in respective positions of both end portions of the other electrode, and having the operating members at the respective end portions; and a pair of frame-shaped followers which are respectively secured onto the both end portions of the other electrode, and into which followers the cams of the cam shafts are respectively fitted. According to this construction, it is possible to compose the opening and closing mechanism in a small-size and in a simple construction. In addition, the both end portions of the other electrode are moved so as to be opened or closed by means of the cam shafts supported on the pair of electrode holders, thus securing the opening and closing operation.

In case that the homopolar electrodes are arranged vertically so as to face to each other in the bath tank, the opening and closing mechanism comprises a sliding system provided between upper electrode-holders and a bus bar for the other electrode, and a linear-type actuator for sliding the other electrode on the sliding system. According to this construction, it is possible to move the other electrode in low friction, with the result that the electrode can be moved by a small force, thus making it possible to use small-sized actuators.

A function of the plating apparatus or the cleaning apparatus of the present invention for attainment of the second object of the present invention will be described hereafter. In this apparatus, the solution on the upstream side relative to the travelling direction of the strip between the stabilizers is kept in the negative pressure condition, because a part of the solution accompanies with the running strip in the travelling direction thereof. The part of the solution kept in the negative pressure condition constitutes a suction side of the solution. As a result, the solution at the outer surface side of the electrode is sucked to the inner surface side thereof through the penetration holes for interconnecting the inner and outer surfaces of the electrode. First, the thus sucked solution enters a fluid-storing room of each of stabilizing members for solution flow, which is provided on the suction side. Second, the pressure of the sucked solution is uniformed in the fluid-storing room, and then, the solution flows toward the strip through a hole of the strip.

In this stage, the solution from the slit-shaped hole has a uniform flow, thus making it possible to carry out a plating treatment or a cleaning treatment without causing any irregularities.

On the other hand, the pressure of the solution on the downstream side relative to the travelling direction of the strip between the stabilizers becomes high, because of the blockage of the flow of the solution by means of the stabilizer, thus constituting a discharge side. As a result, the solution is discharged toward the outside surface side of the electrode through the penetration holes for interconnecting the inner and outer surfaces of the electrode.

Part of the solution flows along the inner surface of the electrode toward the upstream side relative to the travelling direction of the strip.

A turbulent flow is caused due to the existence of the penetration holes. The stabilizing members for solution flow also provided on the above-mentioned discharge side makes it possible to cause a uniform flow on the discharge side.

The necessity of providing the stabilizing members for solution flow on the discharge side depends on a distance between the penetration holes, a diameter thereof, and the like.

The stabilizing members for solution flow secured to the electrode causes decrease in area of the electric discharging face of the electrode by the area thereof to which the stabilizing members for solution flow are secured. The use of the stabilizers having a function of the stabilizing members for solution flow however makes it possible to prevent the above-mentioned decrease in area of the electric discharging face of the electrode.

When the fluid-storing room is formed in cooperation with the denting portion formed in the electrode, the length of the projecting portion of the stabilizing member for solution flow from the surface of the electrode can be decreased. The use of the stabilizer having the function of the stabilizing member for solution flow makes it possible to prevent the increase in length of the projecting portion of the stabilizer from the surface of the electrode, with the result that a further small distance between the electrodes can be maintained.

The stabilizing members for solution flow are made of a material having a heat-resistance property and/or a chemical-resistance property. This makes it possible to prevent them from being deformed by heat and/or chemicals, leading to maintenance of a proper function of the stabilizing members for solution flow. It is also possible to prevent the contact of the stabilizing members for solution flow with the strip due to the deformation of them.

There are formed, in the electrodes or the stabilizing members for solution flow, mounting holes for absorbing the thermal expansion of the stabilizing members for solution flow, which also has a function of holes for securing the stabilizing members for solution flow. This makes it possible to prevent the stabilizing members for solution flow from being deformed, even if a material of them and a material of the electrodes are different from each other (and there is a difference in thermal expansion between them), and if the stabilizing members for solution flow are swelled, thus preventing the contact of them with the strip.

A function of the plating apparatus or the cleaning apparatus of the present invention for attainment of the third object of the present invention will be described hereafter. A plating treatment or a cleaning treatment is carried out by moving ions from the electric discharging face of the anode in the solution, or depositing ions on the electric discharging face of the cathode. Since the upper end of the electric discharging face of the anode or cathode is located below the surface of the bath in the bath tank, the electric discharging face is always immersed in the solution, thus making it possible to carry out the plating treatment or the cleaning treatment without causing any irregularities.

BRIEF DESCRIPTION OF THE DRAWINGS

FIG. 1(*a*) is a perspective view illustrating the strip treating apparatus of the first embodiment of the present invention for attaining the first object of the present invention.

FIG. 1(*b*) is a top plan view illustrating the fitting condition of the cam into the frame-shaped follower shown in FIG. 1(*a*).

FIG. 2 is a perspective view illustrating the modified embodiment of the strip treating apparatus as shown in FIG. 1(*a*);

FIG. 3 is a perspective view illustrating the strip treating apparatus of the second embodiment of the present invention, for attaining the first object of the present invention;

FIG. 4 is an enlarged front view illustrating the opening and closing mechanism of the modified embodiment of the strip treating apparatus as shown in FIG. 3.

"FIG. 5(*a*)–(*e*) relate to the strip treating apparatus of the fist embodiment of the present invention, for attaining the second object of the present invention, FIG. 5(*a*) is a perspective view illustrating the anode or cathode from the inside thereof, FIG. 5(*b*) is a perspective view illustrating the stabilizing member for solution flow, FIG. 5(*c*) is a vertical sectional view illustrating the stabilizing member for solution flow, FIG. 5(*d*) is a transverse sectional view illustrating the stabilizing member for solution flow and FIG. 5(*e*) is a plane view of the anode or cathode from the inside thereof, illustrating the flowing condition of the solution;", and replace with:

FIG. 5(*a*) is a perspective view illustrating the anode or cathode of the first embodiment of the present invention.

FIG. 5(*b*) is a perspective view illustrating the stabilizing member for solution flow shown in FIG. 5(*a*).

FIG. 5(*c*) is a cross-sectional view of the stabilizing member for solution flow shown in FIG. 5(*b*).

FIG. 5(*d*) is a top plan view, partially in section, of the stabilizing member for solution flow and anode or cathode shown in FIG. 5(*a*).

FIG. 5(*e*) is a front elevational view of the anode or cathode shown in FIG. 5(*a*).

"FIG. 12(*a*) is a descriptive plane view illustrating the strip treating apparatus of the embodiment of the present invention, for attaining the third object of the present invention, FIG. 12(*b*) is a descriptive side view illustrating the same apparatus, FIG. 12(*c*) is a plane view illustrating the anode or cathode from the inside thereof of the same apparatus and FIG. 12(*d*) is a side view illustrating the same anode or cathode;", and replace with:

FIG. 12(*a*) is a front elevational view, partially in section, showing the passage of a strip by the anode or cathode of the strip treating apparatus of the present invention.

FIG. 12(*b*) is a side elevational view showing anodes or cathodes of the subject invention disposed face to face.

FIG. 12(*c*) is a front elevational view of the anode or cathode shown in FIG. 12(*a*).

FIG. 12(*d*) is a side elevational view of the anode or cathode shown in FIG.12(*c*).

FIG. 15(*b*) is a side elevational view showing passage of a strip between conventional anodes or cathodes disposed face to face.

"FIG. 16(*a*) is a plane view illustrating the conventional plating or cleaning apparatus provided with the solution supplying apparatus for preventing the accompanying of the solution and FIG. 16(*b*) is a side view illustrating the same conventional apparatus.", and replace with:

FIG. 16(*a*) is a front elevational view, partially in section, showing the conventional anode or cathode of FIG. 15(*a*) with a solution level regulator.

FIG. 16(*b*) is a side elevational view showing the conventional anodes or cathodes of FIG. 15(*b*) with solution level regulators.

DETAILED DESCRIPTION OF THE PREFERRED EMBODIMENT

Figure 5A:
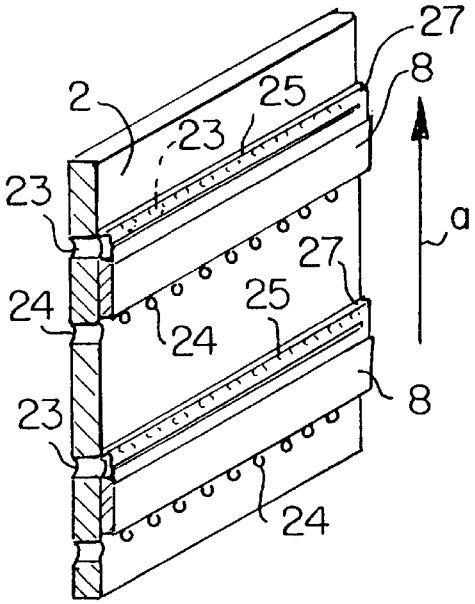
Figure 5B:
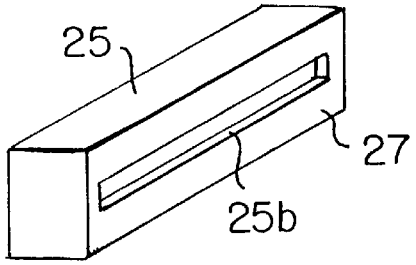
Figure 5C:
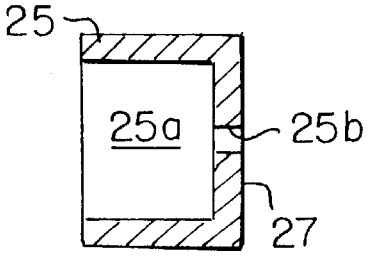
Figure 5E:
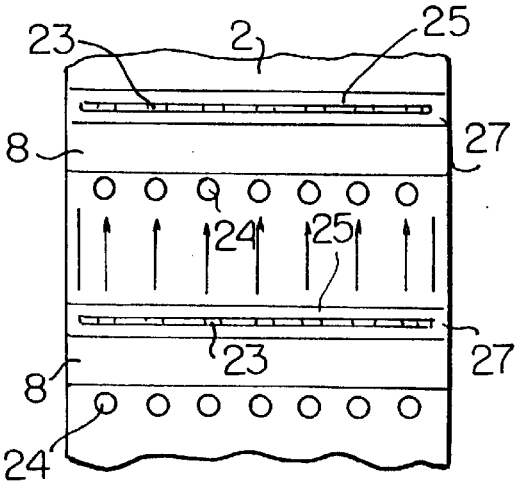
Figure 5D:
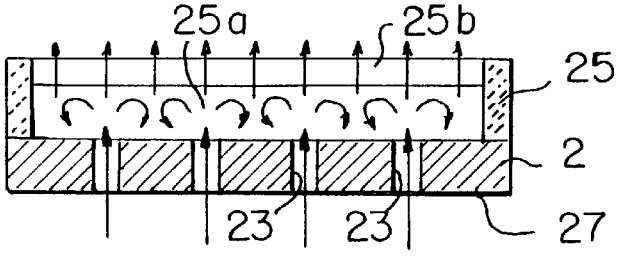

The embodiment of the strip treating apparatus of the present invention for attaining the first object of the present invention will be described hereafter with reference to the drawings. A plating solution (not shown) is stored in a vertical-pass type bath tank 1, and anodes 2, 2 are vertically arranged face to face in the plating solution so that the upper end portions 2*d*, 2*d* of the anodes 2, 2 are located above the surface of the bath (not shown) in the bath tank 1, as shown in FIG. 1(*a*). Insulators (stabilizers) are provided so as to be projected on the inner surface of each of the electrodes 2. Each of the insulators has a slant face (not shown) inclined from the side of the electrode toward the strip in the traveling direction of the strip (i.e., in the downward direction in FIG. 1(*a*) ). A bus bar 2*c* is secured to the upper end of the electrode 2. An electric current is supplied through the bus bar 2*c* to the electrode.

One electrode 2*a* of the homopolar electrodes arranged so as to face to each other is stationarily secured. More specifically, upper electrode-holders 3 and lower electrode-holders 5 are secured in the bath tank 1 so that bus bar fitting portions 3*a* of the upper electrode-holders 3 and bus bar fitting portions 5*a* of the lower electrode-holders 5 are placed at the respective prescribed positions, the bus bars 2*c* respectively provided at the upper and lower ends of the one electrode 2*a* are fitted into the above-mentioned bus bar fitting portions 3*a*, 5*a*. The one electrode 2*a* is arranged at a prescribed position and stationarily secured thereto in this manner. The upper electrode-holders 3 are arranged above the surface of the bath in the bath tank 1. The one electrode 2*a* may be stationarily secured in close proximity to the wall of the bath tank 1.

The upper bus bar 2*c* for the other electrode 2*b* is slidably mounted on the upper electrode-holders 3. The other electrode 2*b* is therefore openable and closable relative to the one electrode 2*a*.

Stopper portions 3*b*, 5*b*for limiting the sliding position of the other electrode 2*b* under the closed condition are provided on the upper and lower electrode-holders 3, 5, respectively. There is provided an opening and closing mechanism 20 for the other electrode 2*b*. More specifically, cam shafts 20*a* are rotatably supported in the upper and lower pairs of electrode-holders 3, 5, respectively. Cams 20*b* are secured to the cam shafts 20*a* at positions of the both end portions of the other electrode 2*b*. Operating members 20*c* comprising manually operated levers are fixed to the respective upper ends of the cam shafts 20*a*. The operating members 20*c* are arranged above the surface of the bath in the bath tank 1. Each of the cams 20*b* comprises a disc-shaped eccentric cam as shown in FIG. 1(*b*). When the manually operated lever 20*c* is turned to a position at right angle to the electrode, the other electrode 2*b* is moved and urged against the stopper portions 3*b*, 5*b*so as to set the other electrode in the closed position. When the manually operated lever 20*c* is turned to a position parallel to the electrode, the other electrode 2*b* is moved together with frame-shaped followers 20*d* described later so as to set the other electrode in the opened position. The eccentricity of the cam 20*b* is previously determined so as to secure a prescribed distance between the electrodes, which permits the passing of a rope between them by only moving the other electrode. The frame-shaped followers 20*d* are provided at the both end portions of the other electrode by securing these followers 20*d* to the bus bars 2*c*. Each of the frame-shaped followers 20*d* has a rectangular space, and the short side of this rectangular space has a length substantially identical to the longer diameter of the cam 20*b* so that the cam 20*b* is fitted into the frame-shaped follower 20*d*. When the eccentric cam 20*b* is turned, the frame-shaped follower 20*d* follows the eccentric cam 20*b* to change its position.

A conducting drum 7 is arranged in the bottom portion of the bath tank 1. The strip travelling between the pair of electrodes 2, 2 is stretched over the conducting drum 7 so as to change the travelling direction thereof.

When there is conducted a work of passing through a rope between the electrodes in the strip treating apparatus having the above-described construction, prior to the start thereof, the manually operated lever 20*c* is turned to a position parallel to the electrode (as shown by dotted lines in FIG. 1(*b*)). As a result, the frame:shaped followers at the both of the upper end portions and the lower end portions of the other electrode move in the following action of the turning of the eccentric cams, to cause the other electrode to be set in the opened position. In this stage, the both of the upper end portions and the lower end portions of the other electrode are moved, thus ensuring the opening and closing. The opening and closing operation can easily be conducted by only turning the manually operated levers 20*c* arranged above the surface of the bath in the bath tank. In this stage, the one electrode is stationarily secured at the prescribed closed position, as mentioned above. Since the insulators (the stabilizers) are provided on this electrode, the strip may slide on the insulators without being in contact with this electrode during the passing of the rope between the electrodes in the strip treating apparatus prior to the start thereof, thus preventing the contact of the strip with the electrode. In this stage, the insulators (the stabilizers) are not damaged or broken, since the strip is not tensed.

After the completion of the work of passing through the rope between the electrodes in the strip treating apparatus prior to the start thereof, the strip is stretched over the conducting drum 7 so as to change the travelling direction thereof. Then, the manually operated lever 20*c* is turned to a position at right angle to the electrode (as shown by solid lines in FIG. 1(*b*)). As a result, the frame-shaped followers 20*d* move in the following action of the turning of the eccentric cams in a direction opposite to that in the above-described opening operation, to cause the other electrode to be set in the closed position. When the other electrode is in contact with the stopper portions 3*b*, 5*b*, the closing operation is completed. The closing condition of the other electrode can be firmly maintained by urging the bus bars 2*c* against the stopper portions 3*b*, 5*b*by means of the eccentric cams 20*b*. Each of the manually operated levers has a prescribed length so that it can be turned by a small force under the action of leverage.

After the thus completion of the work of passing through the rope between the electrodes in the strip treating apparatus prior to the start thereof, the strip is subjected to the plating treatment at a high current density.

In case of passing through the weld-connected portion of the strips, which has a relatively large thickness, between the electrodes, the other electrode 2*b* is again moved to its opened position to pass through the above-mentioned weld-connected portion between the electrodes, and then, the plating treatment is carried out at a high current density in the same manner as mentioned above, if necessary.

In the above-described embodiment, the manually operated levers can be substituted by automatically operating means. A rotary cylinder 20*f* for turning the cam shaft 20*a* is for example provided at the upper end of each of the cam shafts 20*a* as shown in FIG. 2. In this case, the rotary cylinder 20*f* is arranged above the surface of the bath in the bath tank 1, thus making it possible to prevent the rotary cylinder 20*f* having electric circuits being exposed to the treating solution such as a plating solution in the bath tank 1.

Now, the second embodiment of the strip treating apparatus of the present invention for attaining the first object of the present invention will be described hereafter with reference to FIG. 3.

In FIG. 3, the other electrode 2*b* is slidably arranged on the upper electrode-holders 3 so as to be openable and closable. A pneumatic cylinder 21*f* as the opening and closing mechanism is fixed to each of the upper electrode-holders 3. More specifically, the free end of the operating shaft 21*a* of each of the pneumatic cylinders 21*f* is secured to each of the both end portions of the upper bus bar 2*c* for the other electrode 2*b*. A vertical shaft 21*b* is firmly connected to the middle portion of the operating shaft 21*a* of each of the pneumatic cylinders 21*f*. The lower end portion of each of the vertical shafts 21*b* is bent at right angles to form a horizontal portion 21*c*. The free end of the horizontal portion 21*c* of each of the vertical shafts 21*b* is secured to each of the both end portions of the lower bus bar 2*c* for the other electrode 2*b*. The above-mentioned pneumatic cylinders 21*f* serve as automatically operating means. Stopper portions 3*b*, 5*b*for limiting the sliding position of the other electrode 2*b* under the closed condition are provided on the upper and lower electrode-holders 3, 5, respectively.

In the above-described construction, when the pneumatic cylinders 21*f* are operated to retract the operating shafts 21*a* thereof, the other electrode 2*b* slides on the upper electric-holders 3 so as to be in the opened position. In this stage, the force is directly transmitted to the upper and lower end portions of the other electrode 2*b* by the movement of the operating shafts 21*a*, since the operating shafts 21*a* are connected to the lower bus bar for the other electrode 2*b* through the vertical shafts 21*b*. This makes it possible to smoothly open and close the other electrode 2*b* without causing the undesirable swing of the electrode 2*b*, even when the upper electrode-holders 3 have a relatively large coefficient of friction with the result that there may be easily caused the undesirable swing of the electrode 2*b* during the sliding thereof.

In the above-described embodiment, the frictional force on the sliding face can be further decreased. There is provided a sliding system as shown in FIG. 4, which comprises an LM guide member 22*a* secured on the upper electrode 3 between the upper electrode-holder 3 and the upper bus bar 2*c* for the other electrode 2*b* ; and a fitting member 22*b* secured to the upper bus bar 2*c*, into which the above-mentioned LM guide member 22*a* is fitted. The linear actuator 22*c* comprising the pneumatic cylinder is fixed to the upper electrode-holders 3, and the free end of the operating shaft 22*d* of the linear actuator 22*c* is secured to the upper bus bar 2*c*. Since the frictional force on the sliding face is small in the above-mentioned construction, the other electrode can be opened or closed by the operation of small-sized pneumatic cylinders. The other electrode can be moved without swinging, resulting in relief of the necessity of providing the vertical shafts for connecting the operating shafts 22*d* with the lower portions of the other electrode, thus simplifying the opening and closing mechanism.

The present invention is applied to the plating apparatus in the above-described embodiment. The present invention can also be applied to the other strip treating apparatus, for example, a cleaning apparatus in which impurities adhered on the surface of the strip are electrolytically removed in an alkaline treating solution. In this case, the electrodes serve as a cathode.

Now, the embodiment of the strip treating apparatus of the present invention for attaining the second object of the present invention will be described hereafter with reference to the drawings.

Electrodes 2 which serve as an anode or a cathode, are arranged so as to face to each other in the bath tank (not shown) of the plating or cleaning apparatus of the present invention as shown in FIG. 5. Stabilizers 8 are arranged on the opposite surfaces of these electrodes 2 (one of them is only shown in FIG. 5(*a*) ).

Each of the stabilizers 8 has a slant face inclined from the side of the electrode toward the strip in the travelling direction a" of the strip. A proximate portion above the stabilizer 8 and another proximate portion below the stabilizer 8 as shown in FIGS. 5(*a*) and 5(*e*) constitute a suction side and a discharge side of a solution, respectively. A plurality of penetration holes 23, 24 which interconnect the inner and outer surfaces of the electrode, are formed along the stabilizer 8 in the electrode.

Stabilizing members for solution flow 25 are provided to the inner surface of the electrode 1 on the suction side. Each of the stabilizing members for solution flow 25 has a box-shape as shown in FIGS. 5(*b*), 5(*c*) and 5(*d*). The stabilizing member for solution flow 25 covers the plurality of penetration holes 24 formed along the stabilizer on the suction side of the solution, so as to form a fluid-storing room 25*a* in the stabilizing member for solution flow 25.

The stabilizing member for solution flow 25 has a slit-shaped hole 25*b*formed in the wall thereof at the side of the strip. The slit-shaped hole 25*b*has a length identical to that of the row of penetration holes 23, and is arranged at right angles to the travelling direction of the strip. The stabilizing member for solution flow 25 is projected from the surface of the electrode 2. The stabilizing member for solution flow 25 is preferably be made of an insulating material having heat-resistance property and chemical-resistance property, taking into consideration the possibility of the contact of them with the strip.

According to the plating or cleaning apparatus of the present invention having the above-described construction, a plating solution or a cleaning solution flows toward the inner surface side of the electrode 1 through the penetration holes 23 from the outer surface side of the electrode 2. The pressure of the solution is uniformed in the fluid-storing room 25*a* of the stabilizing member for solution flow 25,and then, the solution flows toward the strip through the slit-shaped hole 25*b*. In this stage, the flow of the solution is converted into a uniform flow, thus making it possible to carry out a plating treatment or a cleaning treatment without causing any irregularities. The solution dammed up by the stabilizer 8 on the discharge side is discharged toward the outer surface side of the electrode through the penetration holes 24.

Part of the solution flows along the inner surface of the electrode toward the upstream side relative to the travelling direction of the strip.

Figure 6:
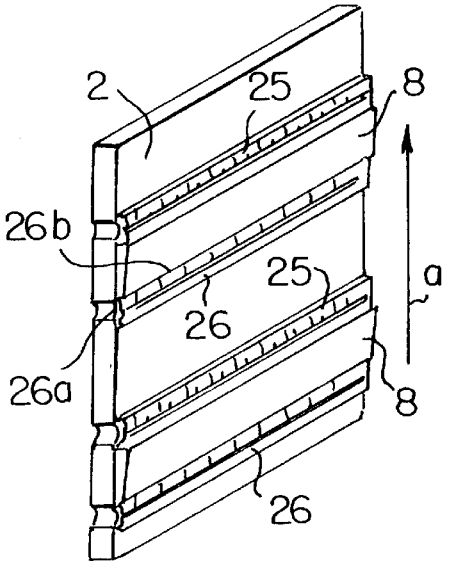
FIG. 6 is a perspective view illustrating the anode or cathode from the inside thereof of the strip treating apparatus of the second embodiment of the present invention, for attaining the second object of the present invention.

Now, the second embodiment of the strip treating apparatus of the present invention for attaining the second object of the present invention will be described hereafter with reference to FIG. 6. In addition to the components of the above-described first embodiment of the present invention, stabilizing members for solution flow 26 having the same shape as in the first embodiment are also arranged on the discharge side (i.e., the side of the penetration holes 24).Accordingly, the solution dammed up by the stabilizer 8 flows into the fluid-storing room 26*a* of the stabilizing member for solution flow 26 through the slit-shaped hole 26*b* of the stabilizing member for solution flow 26. Although a stirring is caused in the fluid-storing room 26*a*, such a stirring in the fluid-storing room 26*a* does not give an adverse effect to the surface of the strip, thus making it possible to prevent causing irregularities of the plating or cleaning in the proximity of the discharge side. The influence of the stirring caused on the discharge side on the irregularities of the plating or cleaning is smaller than that of the stirring caused on the suction side. The provision of the stabilizing member for solution flow on the discharge side is therefore not so important as the provision thereof on the suction side. The stabilizing member for solution flow on the discharge side may be omitted, depending on a distance between the penetration holes, a diameter thereof, and the like.

Figure 7:
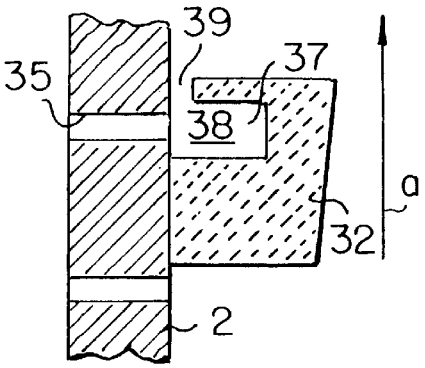
FIG. 7 is a sectional view illustrating the stabilizer in the strip treating apparatus of the third embodiment of the present invention, for attaining the second object of the present invention.

Now, the third embodiment of the strip treating apparatus of the present invention for attaining the second object of the present invention will be described hereafter with reference to FIG. 7. Penetration holes 35 are formed in the electrode on the suction side so as to face to a stabilizer 32. In addition, a portion of the stabilizer 32, which faces to the penetration holes 35, serves as a stabilizing member for solution 37. More specifically, the stabilizer 32 is provided with a denting portion for the fluid-storing room 38 which faces to the penetration holes 35. A slit-shaped hole 39 is formed between the electrode 2 and the upstream end of the stabilizer 32 relative to the travelling direction a" of the strip so that the slit-shaped hole 39 communicates with the fluid-storing room 38. Such a construction in which the stabilizer also serves as a stabilizing member for solution flow, prevents the decrease in area of the electric discharging face of the electrode.

Figure 8:
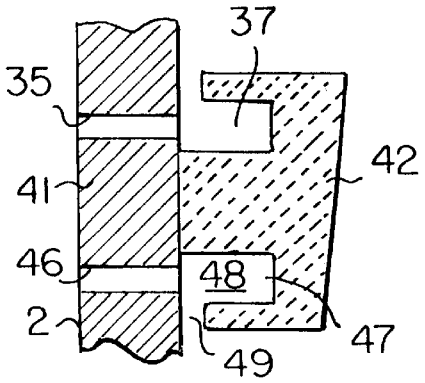
FIG. 8 is a sectional view illustrating the stabilizer in the strip treating apparatus of the fourth embodiment of the present invention, for attaining the second object of the present invention.
Figure 12A:
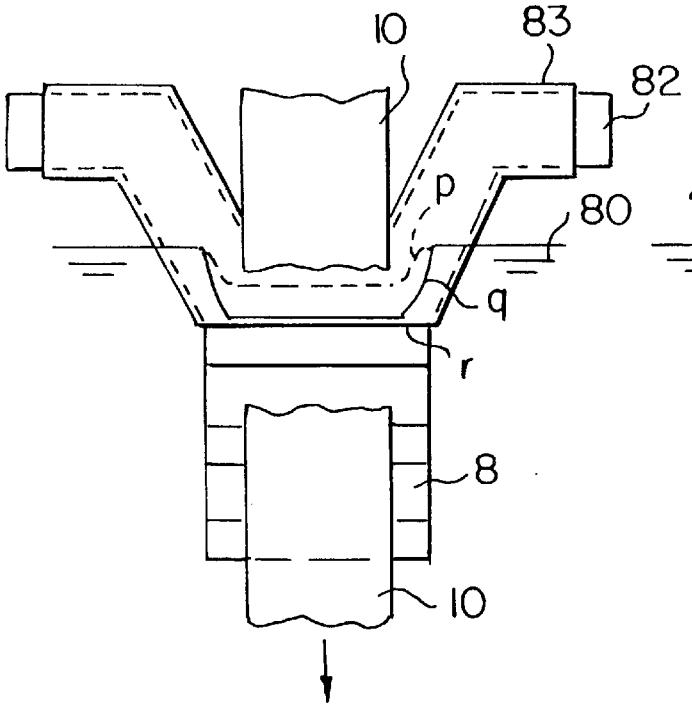
Figure 12B:
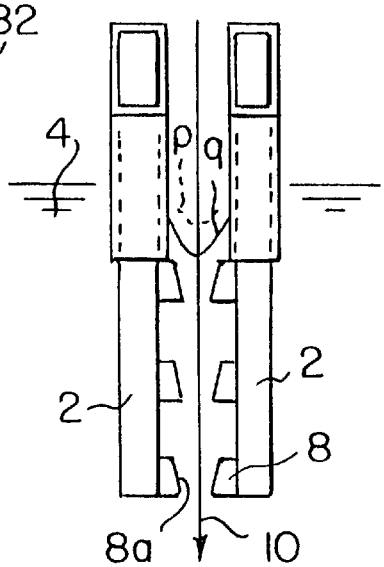
Figure 12C:
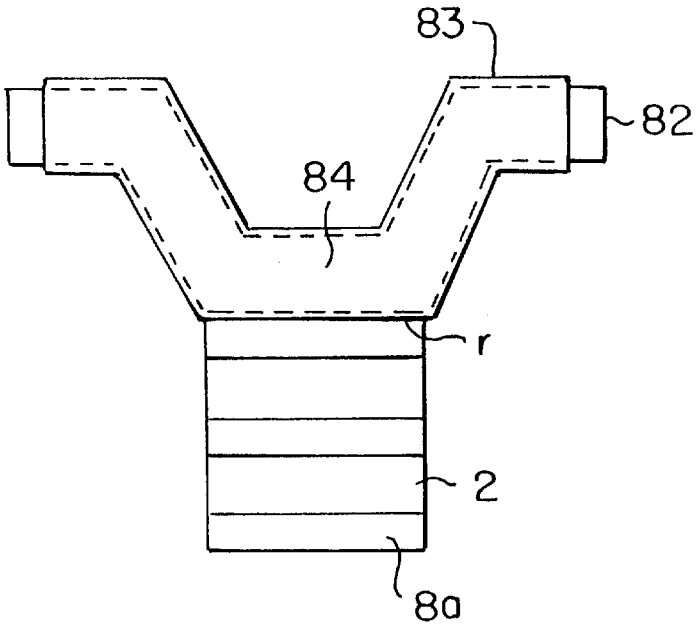
Figure 12D:
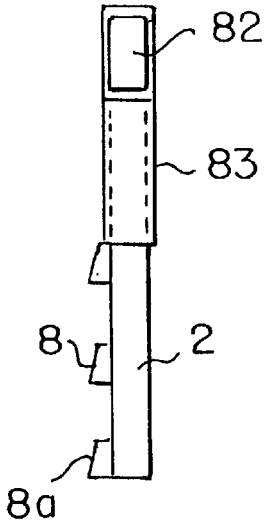

According to the fourth embodiment of the strip treating apparatus of the present invention for attaining the second object of the present invention, penetration holes 46 are formed in the electrode on the discharge side so as to face to a stabilizer 42 as shown in FIG.8. In addition, a stabilizing member for solution flow 47 is formed in the stabilizer 42 so as to face to the penetration holes 46. More specifically, the stabilizer 42 is provided with a denting portion for the fluid-storing room 48 which faces to the penetration holes 46. A slit-shaped hole 49 is formed between the electrode 2 and the downstream end of the stabilizer 42 relative to the travelling direction of the strip 3 so that the slit-shaped hole 39 communicates with the fluid-storing room 38.

Figure 9:
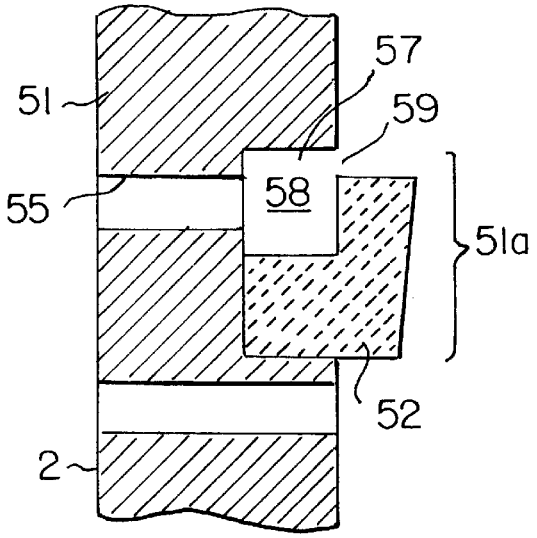
FIG. 9 is a sectional view illustrating the stabilizer in the strip treating apparatus of the fifth embodiment of the present invention, for attaining the second object of the present invention.

Now, the fifth embodiment of the strip treating apparatus of the present invention for attaining the second object of the present invention will be described hereafter with reference to FIG. 9. A denting portion 51*a* is formed in the electrode 51 so as to communicate with the penetration holes 55 on the suction side. A stabilizer 52 having an L-sectional shape is arranged in the denting portion 51*a* so as to form a fluid-storing room 58. A slit-shaped hole 59 is formed between the electrode 51 and the stabilizer 52. The construction in which the fluid-storing room is formed in the stabilizer so that the stabilizer serves as a stabilizing member for solution flow, leads to enlargement of the stabilizer (as in the first and second embodiments). Although the stabilizer interferes with the decrease in a distance between the electrodes in principle, it is possible to decrease the length of the projecting portion of the stabilizer from the surface of the electrode, by forming the denting portion in the electrode and using same as a part of the fluid-storing room, thus permitting the maintenance of the decreased distance between the electrodes.

Figure 10:
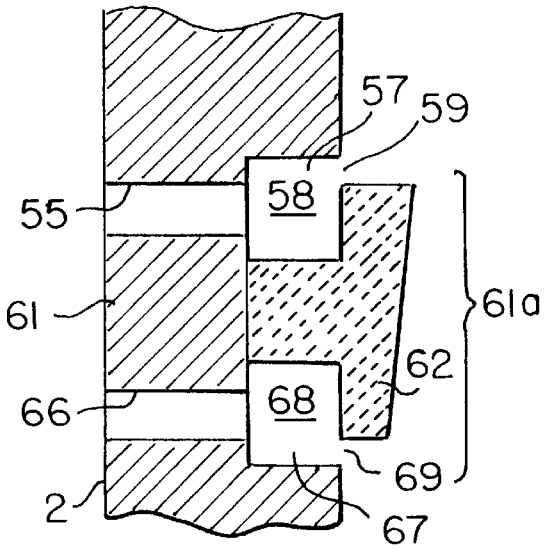
FIG. 10 is a sectional view illustrating the stabilizer in the strip treating apparatus of the sixth embodiment of the present invention, for attaining the second object of the present invention.

According to the sixth embodiment of the strip treating apparatus of the present invention for attaining the second object of the present invention, there is formed in the electrode a denting portion 61*a* which also extends to the position of the penetration hole 66 on the discharge side as shown in FIG. 10. A stabilizer 62 having a T-sectional shape is arranged in the above-mentioned denting portion 61*a* so as to form also a fluid-storing room 68. A slit-shaped hole 69 is formed between the electrode 61 and the stabilizer 62.

Figure 11:
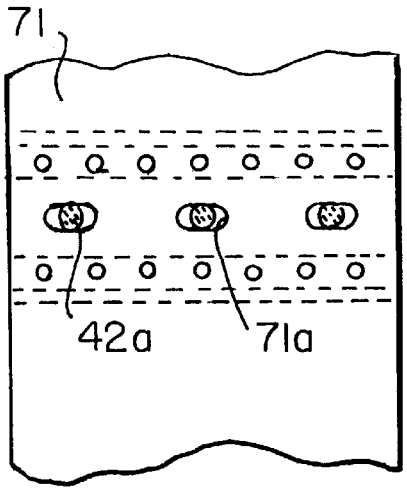
FIG. 11 is a front elevational view, partially in section illustrating the anode or cathode from the outside thereof of the strip treating apparatus of the seventh embodiment of the present invention, for attaining the second object of the present invention.
Figure 13:
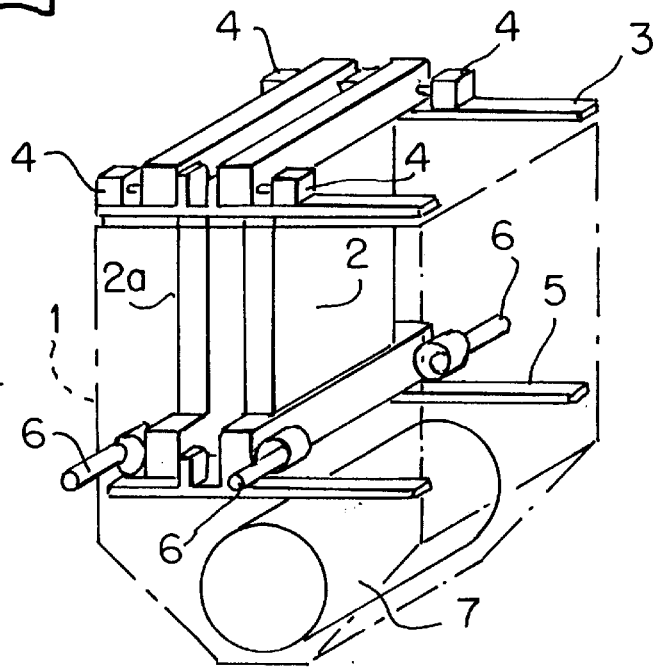
FIG. 13 PRIOR ART
FIG. 13 is a perspective view illustrating the conventional strip treating apparatus.
Figure 14:
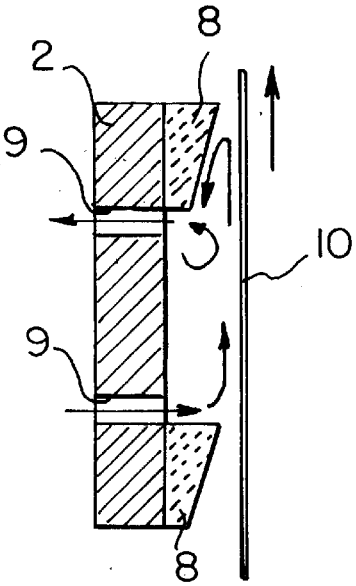
FIG. 14 PRIOR ART
FIG. 14 is a sectional view illustrating the flowing condition of the solution in the conventional plating or cleaning apparatus.
Figure 15A:
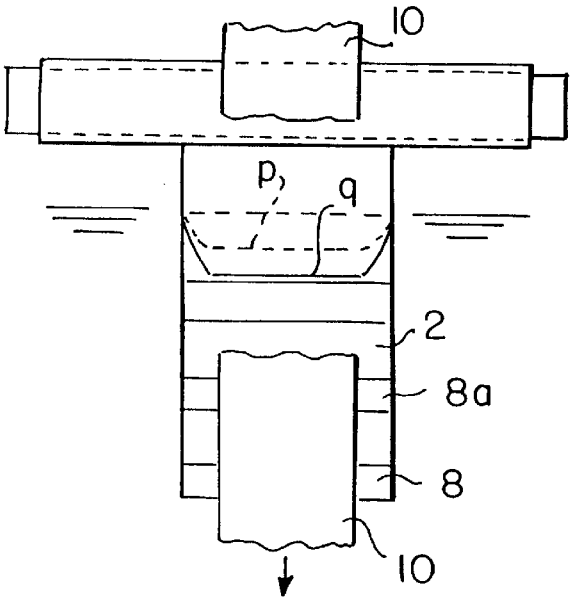
FIG. 15(a) PRIOR ART
FIG. 15(*a*) is a front elevational view showing a conventional anode or cathode in a plating or cleaning solution.
Figure 15B:
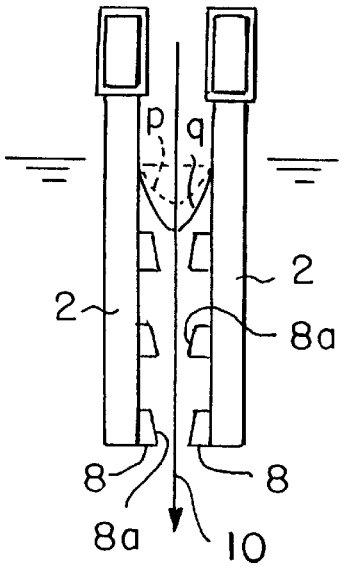
FIG. 15(b) PRIOR ART
Figure 16A:
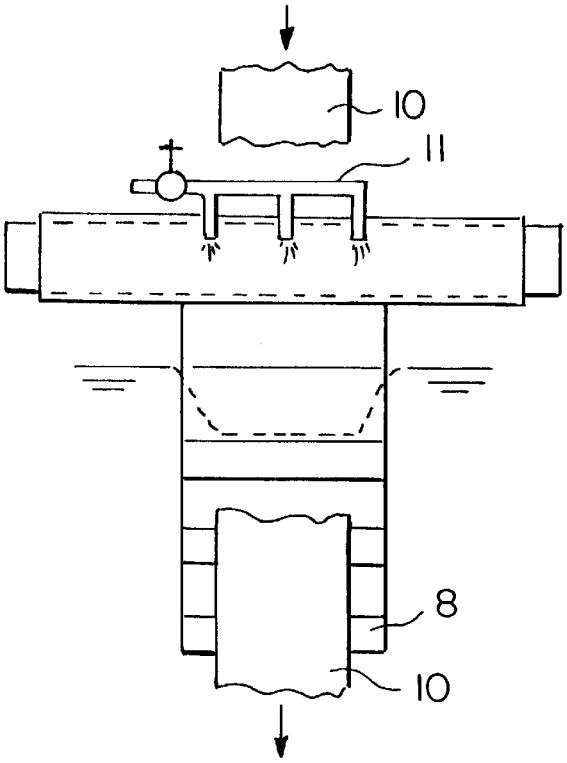
FIG. 16(a) PRIOR ART
Figure 16B:
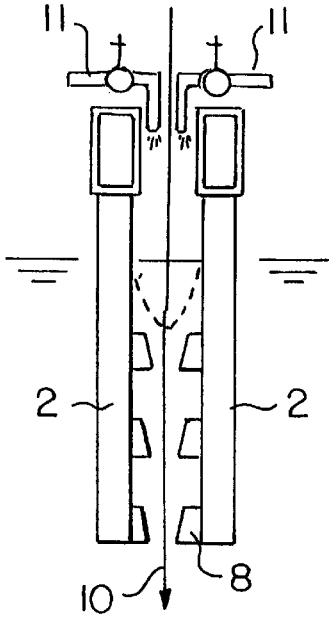
FIG. 16(b) PRIOR ART

Now, the seventh embodiment of the strip treating apparatus of the present invention for attaining the second object of the present invention will be described hereafter with reference to FIG. 11. FIG. 11 is a plane view illustrating the electrode from the outside thereof. Securing shafts 42*a* for a stabilizer 42 which has the same construction as shown in FIG. 8, and also serves as a stabilizing member for solution flow, are loosely fitted into oblong holes 71*a* which are formed in the electrode 71 so that each of the major axes of the oblong holes 71*a* is aligned with the longitudinal line of the stabilizer. Each of the securing shafts 42*a* is fixed to a flange (not shown) which is arranged on the outer surface side of the electrode 71 so as to be slidable on the outer surface thereof. Such a securing method permits the longitudinal expansion and contraction of the stabilizer 42 caused by the change in temperature of the stabilizer. The stabilizing member for solution flow (i.e., the stabilizer serving as a stabilizing member for solution flow in this embodiment)is made of a material different from that of the electrode, there may occur the displacement in position between the electrode and the stabilizing member for solution flow due to the change in temperature thereof. In addition, the above-mentioned stabilizing member for solution flow may absorb the treating solution to cause the swelling thereof. In view of these problems, there are formed in the electrode 71 the oblong holes 71*a* (which also serve as holes for securing the stabilizing member for solution flow) for absorbing the difference in expansion between the stabilizing member for solution flow and the electrode due to thermal expansion thereof so that the stabilizing member for solution flow is movable at the connecting portions of the stabilizing member for solution flow and the electrode, thus preventing the stabilizing member for solution flow from being subjected to the forcible deformation, and from being in contact with the strip.

The stabilizing member for solution flow may be secured to the electrode by forming holes in the corresponding portions of the stabilizing member for solution flow and the electrode, and fastening them by means of bolts passing through these holes and nuts. In this case, there may be formed, in replacement of the above-mentioned holes, holes for absorbing the difference in expansion between the stabilizing member for solution flow and the electrode due to thermal expansion thereof.

Now, the embodiment of the strip treating apparatus of the present invention for attaining the third object of the present invention will be described hereafter with reference to the drawings.

FIG. 12(*a*) is a descriptive plane view illustrating the strip treating apparatus, with one electrode removed, in which a part of a strip is cut off so as to facilitate the understanding of the apparatus. FIG. 12(*b*) is a descriptive side view illustrating the same apparatus. FIG. 12(*c*) and 12(*d*) are plane and side views illustrating a bus bar and an electrode, respectively.

A treating solution such as a plating solution 80 is received in a bath tank (not shown), and electrodes 2 are arranged so as to be face to each other in the bath tank, as shown in FIGS. 12(*a*) and 12(*b*).

Stabilizers 8 are secured to the inner surface of each of the electrodes 2 so as to project from the inner surface thereof, as shown in FIGS. 12(*c*) and 12(*d*). Each of the stabilizers 8 has a slant face 8a inclined from the side of the electrode toward the strip in the travelling direction of the strip. A bus bar 82 for suspending the electrode 1 and supplying an electric current thereto has at its suspending position a portion the surface of which is electrically isolated with a prescribed insulating material 83. This portion is bent downwardly into a U-shape. The electrode 2 is suspended by this bent portion 84. The electrode is not covered with the insulating material. The depth of the bent portion 84 of the bus bar 82 is determined so that the upper end of the electrode, i.e., the lowermost position "r" of the covered portion of the bus bar 82 is located below the lowermost position "q" of the surface of the solution which goes up and down between the electrodes, when the electrode is suspended by the bus bar 82 in the bath tank.

A conductor roll (not shown) is provided above the electrodes 2. After coming into contact with the conductor roll, the strip 10 is travelled downwardly between the opposite electrodes 2, with the result that an electric power is supplied between the bus bar 82 and the conductor roll.

In this construction, the travelling of the strip causes the accompanying of the solution because of the short distance between the electrodes, and as a result, the surface level of the solution goes down between the electrodes, and this surface level varies between the uppermost position "p" and the lowermost position "q". However,since the upper end "r" of the discharging face of the electrode is arranged below the lowermost position "q" of the surface level of the solution, the entire discharging face of the electrode is always immersed into the solution, thus making it possible to carry out the plating or cleaning treatment without causing any irregularities.

Since the bus bar 82 having the insulated surface is bent so that the bent portion thereof is arranged below the solution, and the electrode is suspended downwardly by the bus bar, it is possible to prevent the occurrence of defects such as scratches in the strip, which may be caused by the contact of the strip with the electrode in the position above the solution. In addition, the forming of the bent portion of the bus bar makes it possible to decrease the distance between the conductor roll and the surface level of the solution, thus inhibiting the voltage drop so as to save the electric energy.

According to the present invention, there is no need of preparing a space for moving the one electrode, thus permitting the use of a small-sized bath tank, and also permitting the application of the strip treating apparatus provided with the stabilizers to a conventional bath tank which does not have such a space, since only the other electrode is designed to be openable and closable, and as a result, there can be extended a field area to which the strip treating apparatus can be applied. Since the opening and closing mechanism provided only for the other electrode suffices, the cost of the opening and closing mechanism can be reduced by half.

In case that the homopolar electrodes are arranged vertically so as to face to each other in the bath tank, it is possible to release the necessity of forming holes for operating members of the opening and closing mechanism in the wall of the bath tank and of arranging the above-mentioned operating members so as to project outside from these holes, by arranging all of the operating members of the opening and closing mechanism above the surface of the bath in the bath tank, resulting in prevention of leakage of the bath, and prevention of the damage of the operating members caused by the immersion of the operating members in the bath.

In the present invention, since the stabilizing members for solution flow having the fluid-storing room and the slit-shaped hole are provided, the solution flows through the slit-shaped hole to come into contact with the strip, with the result that the solution having a uniform laminar flow comes into contact with the strip, thus making it possible to carry out the plating or cleaning treatment without causing any irregularities.

In addition, since the apparatus of the present invention has a construction in which the upper end of the discharging face of the anode or cathode is arranged below the surface of the solution in the bath tank, it is possible to carry out the plating or cleaning treatment without causing any irregularities, irrespective of the variation of the surface level of the solution. Since the apparatus of the present invention has a simple construction, the present invention can very easily be worked at a low cost, and the maintenance of the apparatus can also very easily be performed, thus making it possible to cause the plating or cleaning apparatus to become widespread, in which the anodes or cathodes are arranged so as to be face to each other, and there are provided on these electrodes projecting insulators each having the slant face inclined from the side of the electrode toward the strip in the travelling direction of the strip.

What is claimed is:

1. An apparatus for treating a strip, comprising;

at least one pair of homopolar electrodes, arranged to face each other in a bath tank; strip to any one of a plating treatment, a cleaning treatment and another treatment, insulators provided so as to be projected on opposite surfaces of said at least one pair of homopolar electrodes, and each of said insulators has a slant face inclined from a side of each of said at least one pair of homopolar electrodes in a travelling direction of said strip;

one electrode of said at least one pair of homopolar electrodes being stationarily secured to said bath tank; and an opening and closing mechanism for adjusting a distance between said at least one pair of homopolar electrodes being provided at an other electrode of said at least one pair of homopolar electrodes;

said opening and closing mechanism being located above said bath tank.

2. An apparatus for treating a strip, as claimed in claim 1, wherein:

said homopolar electrodes are arranged vertically so as to face to each other in said bath tank; and all of operating members of said opening and closing mechanism are positioned above a surface of a bath in said bath tank.

3. An apparatus for treating a strip, as claimed in claim 2, wherein:

said opening and closing mechanism comprises a bus bar connected to an upper end of said other electrode, upper electrode-holders positioned on an upper end portion of said other electrode, a sliding system for slidably supporting said bus bar on said upper electrode-holders, and a linear actuator for sliding said bus bar on said sliding system.

4. An apparatus for treating a strip, as claimed in claim 1, wherein:

said opening and closing mechanism comprises a pair of electrode holders positioned on both end portions of said other electrode, frame-shaped followers provided at said pair of electrode holders, cam shafts rotatably supported on said electrode holders, cams secured to both end portions of said cam shafts, and fitted into said frame-shaped followers, and operating members provided at one end portions of said cam shafts.

5. An apparatus for treating a strip, comprising:

at least one pair of homopolar electrodes, arranged to face each other in a bath tank;

stabilizers provided on opposite surfaces of said electrodes, said stabilizers each having a slant face inclined from a side of each of said electrodes in a travelling direction of said strip;

a plurality of penetration holes formed in each of said electrodes on an upstream side and a downstream side of each of said stabilizers in a travelling direction of said strip to interconnect inner and outer surfaces of each of said electrodes with each other;

stabilizing members for solution flow provided so as to face said penetration holes on both of said upstream side and said downstream side of each of said stabilizers, or only on said downstream side thereof;

a fluid-storing room formed at a side of said penetration holes of each of said stabilizing members for solution flow; and a slit-shaped hole formed in each of said stabilizing members for solution flow so as to extend in a direction intersecting said travelling direction of said strip.

6. An apparatus for treating a strip, as claimed in claim 5, wherein:

said stabilizers have a function of said stabilizing members for solution flow.

7. An apparatus for treating a strip, as claimed in claim 5, wherein:

said electrodes have denting portions, and said stabilizing members for solution flow are secured in said denting portions.

8. An apparatus for treating a strip, as claimed in claim 5, wherein:

said stabilizing members for solution flow are made of a material having at least one of heat-resistance property and chemical-resistance property.

9. An apparatus for treating a strip, as claimed in claim 5, wherein:

mounting holes for connecting each of said electrodes and said stabilizing members for solution flow are formed in one of said each of said electrodes and said stabilizing members for solution flow, and bolts are secured on an other of said each of said electrodes and said stabilizing members for solution flow, said bolts being loosely fitted into said mounting holes, thereby absorbing a difference in expansion between said stabilizing members for solution flow and said electrodes due to thermal expansion thereof.

10. An apparatus for treating a strip, as claimed in claim 5, wherein:

said electrodes are one of anodes and cathodes, or electrodes changeable into anodes or cathodes.

11. An apparatus for treating a strip, as claimed in claim 5, wherein:

each of said electrodes is supported at the upper end thereof by means of a bus bar covered with an insulating material, a portion of said bus bar for supporting each of said electrodes is formed into a bent-shape, and the upper end of the electric discharging face of each of said electrodes is located below the surface of the bath in said bath tank.

12. A strip treating apparatus comprising:

a tank with a stationary electrode supported in a fixed relationship to said tank;

a movable electrode supported in said tank and movable relative to said stationary electrode;

said movable electrode being movable between a first position and a second position;

said movable electrode and said stationary electrode defining a first channel therebetween when said movable electrode is at said first position;

said movable electrode and said stationary electrode defining a second channel therebetween when said movable electrode is at said second position;

said second channel being wider than said first channel;

an actuator mounted above said tank; and said actuator connected to said movable electrode to move said movable electrode between said first and second positions while said stationary electrode remains in said fixed relationship to said tank.

13. A strip treating apparatus according to claim 12, wherein:

said actuator includes a manually operable member;

said manually operable member positioned outside said tank and connected to said actuator inside said tank by a transmission passing through a wall of said tank, said transmission and said manually operable member being effective to cause said actuator to move said movable electrode between said first and second positions;

said tank together with said movable and stationary electrodes having an operation level to which said tank is filled with a treating solution for treating a strip of material; and said transmission being positioned above said operation level, whereby a leakage of said treating solution through a space between a said transmission and said wall is avoided.

14. A strip treating apparatus according to claim 13, further comprising:

said stationary electrode having an upper inactive portion and a lower active portion;

an electrically insulating layer on an outer surface of only said upper inactive portion, thereby defining a transitional line between said upper inactive portion and said lower active portion;

said upper inactive portion being supported at a fixed height relative to said tank and supporting said lower active portion in said tank;

said operation level of said tank fluctuating between a minimum level and a maximum level during a feeding of said strip of material into said tank; and said transitional line of said stationary electrode being maintained below said operation level of said tank such that said lower active portion of said stationary electrode is always below said minimum level during said feeding of said strip of material into said tank.

15. A strip treating apparatus according to claim 12, wherein:

said strip treating apparatus is in an open position when said movable electrode and said stationary electrode define said second channel therebetween, whereby said second channel permits passage of a lead member larger in width than said strip of material so said lead member can guide said strip of material through said strip treating apparatus.

16. A strip treating apparatus according to claim 15, wherein:

said strip treating apparatus is in a closed position when said movable electrode and said stationary electrode define said first channel; and said width of said first channel being narrower than said width of said lead member, whereby said first channel prevents passage of said lead member through said strip treating apparatus.

17. A strip treating apparatus according to claim 12, wherein:

said stationary electrode has a generally planar surface positioned to face a strip of material being fed into said tank;

said movable electrode has a generally planar surface opposing said planar surface of said stationary electrode and positioned to face said strip of material being fed into said tank; and said movable electrode movable in a perpendicular direction relative to said planar surface of said stationary electrode.

18. A strip treating apparatus comprising:

a tank for holding a strip treating solution;

first and second electrodes supported within said tank;

said first and second electrodes defining a channel therebetween;

a first flow straightening member extending from an inner surface of said first electrode into said channel;

said inner surface of said first electrode and an interior surface of said first flow straightening member defining a plenum chamber;

said first electrode including at least one inlet aperture extending from an outer surface of said first electrode into said plenum chamber;

a front face of said first flow straightening member having a slit communicating said plenum chamber with said channel; and said first electrode including at least one outlet aperture extending from said inner surface to said outer surface such that movement of a strip of material in said channel causes said strip treating solution to circulate from said outer surface of said first electrode through said at least one inlet aperture into said plenum chamber, from said plenum chamber through said slit into said channel, and from said channel through said at least one outlet aperture to said outer surface of said first electrode.

19. A strip treating apparatus according to claim 18, wherein:

said at least one inlet aperture is a plurality of inlet apertures.

20. A strip treating apparatus according to claim 18, wherein:

said at least one outlet aperture is a plurality of outlet apertures.

21. A strip treating apparatus according to claim 18, wherein:

a second flow straightening member extends from an inner surface of said first electrode into said channel;

said inner surface of said first electrode and an interior surface of said second flow straightening member defining a second plenum chamber;

a front face of said second flow straightening member having a slit communicating said channel with said second plenum chamber; and said at least one outlet aperture extending from said second plenum chamber to said outer surface such that movement of said strip of material in said channel causes said strip treating solution to flow from said channel through said slit into second plenum chamber and flow from said second plenum chamber through said at least one outlet aperture to said outer surface of said first electrode.

22. A strip treating apparatus according to claim 21, wherein:

said at least one outlet aperture is a plurality of outlet apertures.

23. A strip treating apparatus according to claim 21, wherein:

a plurality of second flow straightening members are arranged on said inner surface of said first electrode.

24. A strip treating apparatus according to claim 18, wherein:

a plurality of first flow straightening members are arranged on said inner surface of said first electrode.

25. A strip treating apparatus according to claim 18, wherein:

said first electrode is movably mounted within said tank; and said first electrode being movable relative to said second electrode.

26. A strip treating apparatus comprising:

a tank for holding a treating solution;

at least one electrode having an upper active portion and a lower inactive portion;

said tank together with said at least one electrode having an operation level to which said tank is filled with said treating solution for treating a strip of material;

said operation level fluctuating between a minimum level and a maximum level during a feeding of said strip of material into said tank;

an electrically insulating layer on an outer surface of only said upper inactive portion, thereby defining a transitional line between said upper inactive portion and said lower active portion;

said upper inactive portion being supported at a fixed height relative to said tank and supporting said lower active portion in said tank; and said transitional line of said at least one electrode being below said operation level of said tank such that said lower active portion of said at least one electrode is always below said minimum level during said feeding of said strip of material into said tank.

27. A strip treating apparatus according to claim 26, wherein:

said at least one electrode includes first and second electrodes; and said first and second electrodes define a channel.

28. A strip treating apparatus according to claim 27, wherein:

said first electrode is movably mounted within said tank; and said first electrode being movable relative to said second electrode.

* * * * *